United States Patent [19]

Hollander

[11] Patent Number: 4,819,848

[45] Date of Patent: Apr. 11, 1989

[54] APPARATUS FOR MAKING PERFORATED ROOFING MATERIAL

[75] Inventor: Jan Hollander, Zuidhorn, Netherlands

[73] Assignee: B.V. Asphalt-en Chemise Fabrieken Smid & Hollander, Groningen, Netherlands

[21] Appl. No.: 148,413

[22] Filed: Jan. 26, 1988

Related U.S. Application Data

[62] Division of Ser. No. 880,418, Jun. 30, 1986.

[51] Int. Cl.[4] ..... B26F 3/02

[52] U.S. Cl. ..... 225/96; 83/103; 225/93; 225/97; 225/99

[58] Field of Search ..... 225/2, 93, 96, 97, 99; 83/284, 510, 103, 108; 29/432–432.2

[56] References Cited

U.S. PATENT DOCUMENTS

| | | | |
|---|---|---|---|
| 2,021,716 | 11/1935 | Douthett . | |
| 2,353,680 | 7/1944 | MacNutt . | |
| 2,453,599 | 11/1948 | Schlegel | 83/284 X |
| 2,526,811 | 10/1950 | Dawson | 83/510 X |
| 4,220,272 | 9/1980 | Danti | 83/103 X |
| 4,287,248 | 9/1981 | Gessner et al. . | |
| 4,584,753 | 4/1986 | Eckold et al. | 29/432.1 X |

FOREIGN PATENT DOCUMENTS

| | | |
|---|---|---|
| 0135221 | 3/1985 | European Pat. Off. . |
| 2457767 | 12/1980 | France . |
| 419537 | 3/1967 | Switzerland . |

*Primary Examiner*—Frank T. Yost

*Attorney, Agent, or Firm*—Townsend and Townsend

[57] ABSTRACT

A perforated web-like bituminous roofing material comprising a perforated, bituminized carrier, at the side facing, in the condition of use, the roof area to be coated, is provided with a metal foil leaving clear the perforations in the bituminized carrier. The roofing material can be manufactured by finishing one side of a perforated bituminized carrier with fine sprinkling material and coating the other side with an imperforate metal foil, and subsequently removing the metal foil at the perforations.

12 Claims, 2 Drawing Sheets

Figure 3:
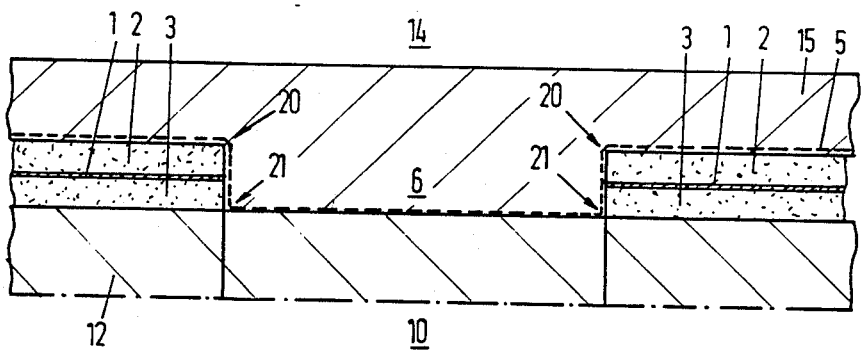

FIG. 1
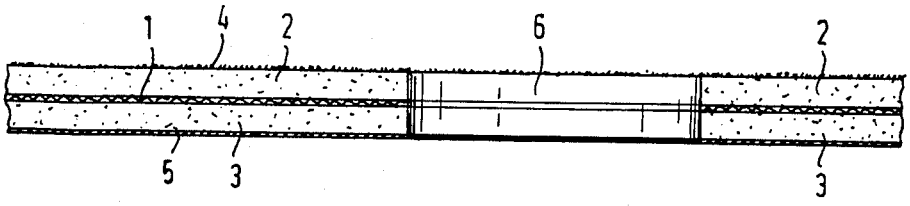
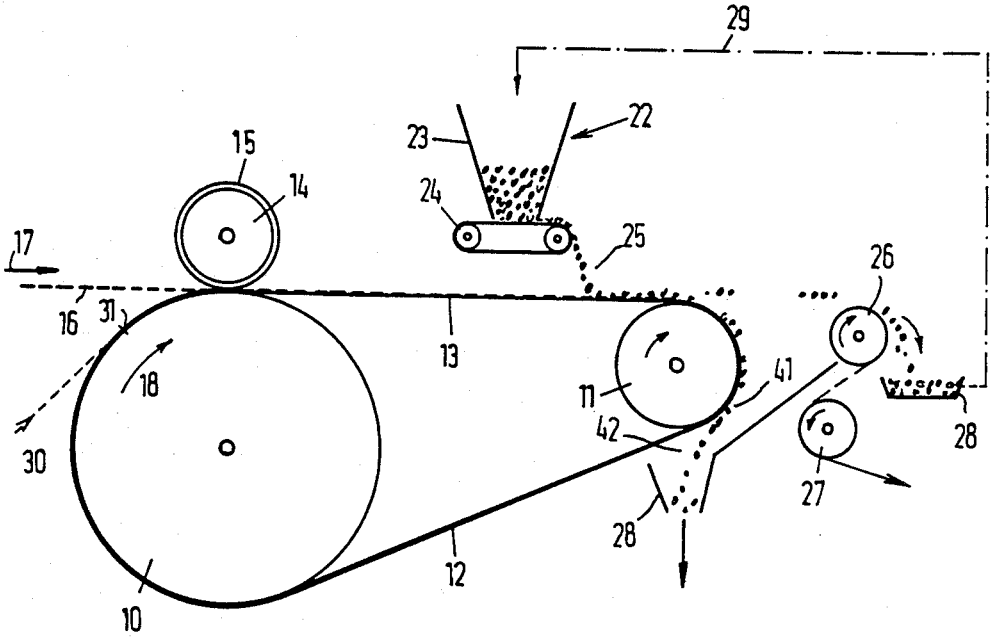
FIG. 2

APPARATUS FOR MAKING PERFORATED ROOFING MATERIAL

This is a division of application Ser. No. 06/880,418 filed June 30, 1986.

The present invention relates to a perforated web-like, bituminous roofing material comprising a perforated bituminized carrier, as well as to a method and apparatus for its manufacture.

A similar roofing material is known from practice in various embodiments and is destined for application as a first layer in a roofing system. The carrier may consist of e.g. glass fabric, synthetic plastics fabric, rag felt, fabrics of glass fibre and jute fibres or synthetic plastics fibres. This carrier is impregnated in, and covered by, the residues of coal tar or mineral oil, or natural bitumen whether or not mixed with synthetic plastics materials, such as polyolefins and/or elastomers. Furthermore, inorganic fillers may be added.

When such a material, after unrolling over a roof area to be coated, is coated with a bituminous binding agent fluidized by heating, a part of the binding agent will effect, via the perforations, a bond with the roof area at the location of the perforations. The rest of the perforated material, however, should not adhere to the roof area, so that between roof area and perforated layer vapor pressure distribution can take place, thereby preventing inconvenient and vulnerable blisters in the roof covering.

Originally, on application of such a perforated roofing material, the bond via the perforations was effected by e.g. applying liquid bitumen with a watering can over the perforated layer, for fluidizing the bitumen, a bitumen heater was used. Subsequently, a cover layer was applied to the perforated material thus applied to the roof area.

Since the use of a bitumen heater has a number of drawbacks, subsequently the so-called burner roller had been developed. This is a roller having at its underside a relatively thick layer of bituminous material heated with a burner during the unrolling over the layer of perforated material unrolled on the roof, so that there is produced in the nip between burner roller and perforated material a kind of bow wave of liquid bitumen, which effects the bond with the roof area via the perforations.

In spite of the use of rather large perforations having a diameter of 7–8 cm and a total surface area of the perforations of 11%–20% of the total web surface area, the bond with the roof area is not always effected in the desired manner when use is made of the known perforated roofing, together with a burner roller.

This is largely due to the fact that with the known perforated roofing materials adapted to be adhered and covered through a burner roller, the perforations are not free.

For instance, a perforated roofing material is commercially available that consists of a perforated glass fabric carrier having on one side a bituminous layer, with the openings in the carrier being filled with bitumen. The bituminous layer is again covered with a thin synthetic plastics foil for preventing self-adherence of the rolled-up material. This known material is applied with the uncoated side of the carrier to the roof area to be coated. Then, a burner roller is installed on the roof and, with addition of heat in and before the nip, is unrolled between burner roller and the perforated material. For this, so much heat is to be supplied that the underside of the burner roller softens, that the plastics foil is burned away and the bitumen present in the perforations becomes fluid. The plastics foil is also called burner foil.

There is thus produced between burner roller and roof area a bond via the bitumen present in the perforations, while between burner roller and perforated layer a bond is produced by the softened underside of the burner roller and the top of the perforated layer likewise softened after the burner foil has been burnt away. The surface area between the perforations at the underside of the perforated material in principle does not bond to the roof, since there is no bitumen at that location.

However, it has been established in practice that on application of such a perforated material, there is the chance that no proper bond is obtained, since the burner foil is not burnt away sufficiently so that the bitumen present in the perforations does not soften sufficiently to effect the bond with the roof area.

Naturally, this problem can be removed by supplying more heat, in which case, however, it is very likely that the perforated material becomes too hot, so that the material in the perforations will flow into the regions between the perforations, resulting in the perforated layer being bonded over too large a surface area to the roof area, thereby loosing the advantages of the use of a perforated substrate.

Other commercially available perforated roofing materials comprise a web of perforated glass fabric having on either side a bituminous layer. The perforations are not filled with bitumen but are coated by a burner foil disposed on one or both sides. With material having burner foil on one side, the bituminous layer on the underside is sprinkled with a fine sprinkling material e.g. sand, to prevent adhesion to the roller.

Here too, the above problems occur: too little heat supplied results in an inadequate bond, while too much heat supplied leads to a bond to the roof between the perforations.

A similar material which, however, is sprinkled on the underside with coarser material, such as fine gravel, is likewise commercially available. Here too, the above problems occur.

Consequently, there is a need for a perforated roofing material suitable for use with a burner roller and less sensitive to the quantity of heat supplied. It is an object of the present invention to satisfy this need. To this effect, according to the present invention, a perforated roofing material of the above described type is characterized in that the bituminized carrier, at the side facing the roof area to be coated in the condition of use, is fitted with a metal foil leaving clear the perforations in the bituminized carrier.

It is observed that a roofing material having on one side an aluminum layer is known per se. This known material, however, is not adapted for use as a perforated substrate in a burner system.

The present invention also relates to a method of manufacturing a roofing material according to the present invention. A method of manufacturing a roofing material according to the present invention is characterized in that in a known manner a perforated bituminized web-like carrier is made which in a likewise known manner is finished with a fine-grained or pulverulent sprinkling material and which on the other side is coated with a metal foil shutting off the perforations, and that subsequently the metal foil is removed at the location of the perforations.

An apparatus for manufacturing a roofing material according to the present invention is characterized by a known per se device for manufacturing a perforated web-like bituminized carrier being sprinkled on the one side with a fine-grained or pulverulent material and on the other side is coated with a metal foil shutting off the perforations; a station for weakening the metal foil along the edges of each perforation; and a station for removing the portions of the metal foil shutting off the perforations and circumferentially weakened.

Figure 4:
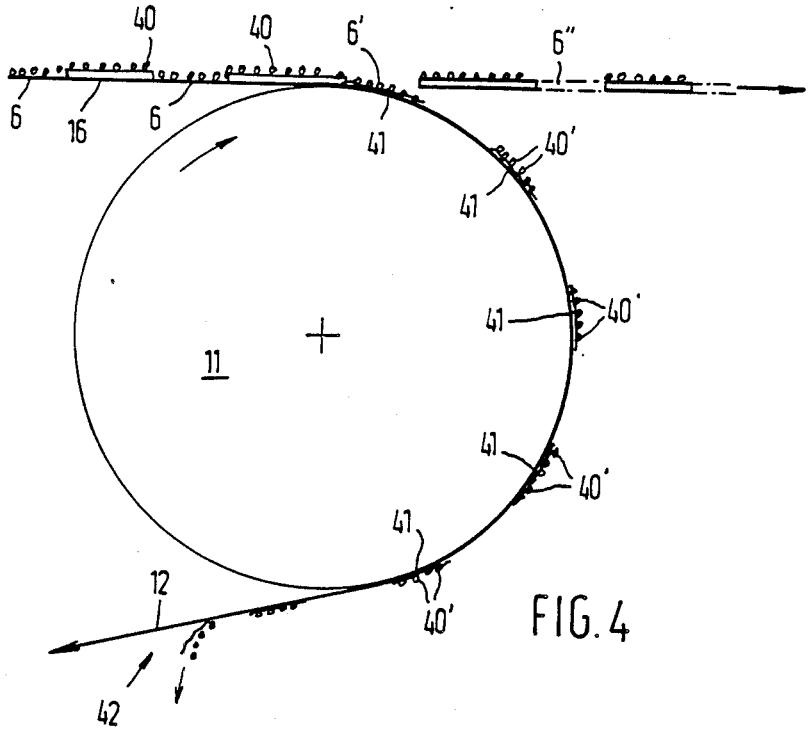

Some embodiments of the present invention will now be described, by way of example, with reference to the accompanying drawings, in which:

FIG. 1 is a cross section of an embodiment of a roofing material according to the present invention;

FIG. 2 diagrammatically shows an embodiment of a part of an apparatus for manufacturing a roofing material according to the present invention;

FIG. 3 shows an enlarged cross-sectional view of the roofing material between the two rollers of FIG. 2; and FIG. 4 shows another detail of FIG. 2.

FIG. 1 is a cross section of a part of a roofing material according to the present invention. The material consists of a carrier 1 made from one of the conventional materials. The carrier is impregnated in bitumen and both at the top (i.e. the side facing away in the condition of use from the roof area) and the bottom side (the side facing the roof) is fitted with a layer of bituminous material 2,3. At the top, the bituminous layer is sprinkled with a fine-grained or pulverulent material 4, such as fine sand or talcum powder or the like. This sprinkling layer prevents adhesion of the roofing material when, as customary, it is rolled up, but on the other hand does not or hardly impede the production of an adequate bond between the burner roller and the perforated roofing material. This in contrast to the burner foil employed with the above described known perforated roofing materials, at the top thereof, which foil is to be carefully burnt away before a proper bond can be produced.

The roofing material shown in FIG. 1 is further coated at the underside with a thin metal foil 5, which may be an aluminum foil but other metal foils are conceivable.

The roofing material shown is fitted with perforations uniformly distributed over the surface area, one of which is indicated in FIG. 1 at 6. The perforations in a preferred embodiment have a diameter of 40–80 mm and occupy about 15%–30% of the surface area.

The perforations in the ready product are fully open and therefore need not be burnt open during the application of the burner roller, as is the case with the above described known materials.

As the perforations are fully open, the bitumen fluidized during the unrolling and the simultaneous heating of the underside of the burner roller can flow without impediments in the form of a burner foil or rests thereof directly into the perforations, thereby effecting a proper bond to the roof area. This bond is enhanced still in that the burner flame used for heating the burner roller heats and dries directly the roof area at the location of the perforations via the perforations.

The employed metal foil has more functions. In the first place, the metal foil prevents adhesion of the material as long as it is present on the roller. This function, however, could, in itself, be performed just as well by a conventional sprinkling material. Therefore, more important is the fact that the metal foil rapidly distributes the heat supplied and concentrated by the burner flame over a large surface area, so that, even if more heat is supplied than is necessary, no overheating can occur between the perforations. The occurrence of adhesion between the surface of the perforated material present between the perforations and the roof area due to bitumen flowing via the perforations from underneath the perforated material is thus prevented. This function is also important from a viewpoint of fire prevention.

Finally, the metal foil forming an impenetrable layer (outside the perforations) which even in the case of strong heating of the perforated layer is not pervious to bitumen in the regions between the perforations, prevents, even in this manner, undesirable adhesion between the underside of the perforated material and the roof area. The manufacture of the above described roofing material can be effected in principle by providing one side of an imperforate, butiminized, web-like carrier, in one of the manners known for the purpose, with a metal foil, and subsequently, conducting the resulting web of material through a punching machine effecting the perforations. This method has the drawback that much material is lost. When the perforations occupy about 20% of the surface area, also 20% of the material is lost. This material is not reusable either.

Consequently, it is another object of the present invention to provide a method and an apparatus eliminating this drawback. The basic idea of the method according to the present invention is based on the application of entirely open perforations in such a manner that loss of material is substantially avoided.

FIG. 2 diagrammatically shows an apparatus for making the perforated material according to the present invention, likewise illustrating an embodiment of a method according to the present invention.

The apparatus comprises a roll 10 of relatively large diameter and a roller 11 spaced apart from roll 10. About roll 10 and roller 11 is wrapped an endless belt 12 whose upper track 13 is substantially horizontal. Above roll 10 is disposed a hold-down roller 14 having a special rubber or synthetic plastics sheath 15, so that the hold-down roller has a relatively easily elastically deformable but yet firm surface.

To the nip between roll 10 and hold-down roller 14 is supplied a perforated and bituminized carrier manufactured. previously in one of the manners known for the purpose, said carrier being fitted on one side with sprinkling material and on the other side with a metal foil, such as aluminum foil, still shutting off the perforations at that moment.

This intermediate product can be made e.g. by conducting a perforated, web-like carrier through a bath of molten bitumen and subsequently, sprinkling the resulting bituminized web on one side in a known manner with e.g. fine sand. The resultant one-sidedly sprinkled web still has perforations, since the bitumen does not fill the perforations in the carrier. After the bituminized web has been sprinkled, an (imperforated) web of metal foil is applied to the other side which is adhered by rolls onto the still hot bitumen of the bituminized web. This technique, too, is known per se and is therefore not further described hereinafter.

The resulting web of material 16 is conducted between roll 10 and hold-down roller 14, as indicated by arrow 17 in such a manner that the metal foil faces hold-down roller 14. In the arrangement shown, the metal foil is thus present on the upper side. Roll 10 is driven in the direction indicated by arrow 18 and the web fitted with the metal foil thus moves to the right. The co-rotating hold-down roller then presses at a predetermined force on the web of material in such a manner that the elastic sheath 15 of the hold-down roller presses the metal foil into the perforations. This is shown on an enlarged scale in FIG. 3, FIG. 3 uses for corresponding elements the same reference numerals as FIG. 1 and FIG. 2. FIG. 3 shows again the bituminized carrier 1, 2, 3 lying on the belt 12 carried by roll 10 and which is pressed down by the sheath 15 of the hold-down roller 14. The metal foil is disposed at the side facing the hold-down roller. The sprinkling material present on the other side of the carrier is not shown in FIG. 3.

In the situation shown in FIG. 3, a perforation 6 is precisely present between roll 10 and hold-down roller 14. Sheath 15 encounters on either side of perforation 6 resistance by the web material present at that location and, consequently, is pressed into the region around the perforation. Adjacent the perforation, sheath 15, however, only encounters the minimal resistance of the metal foil, so that at that location sheath 15 bulges in the perforation and entrains the metal foil, thereby being pressed inwardly along the edges of the perforation, so that the metal foil comes to lie within the perforation 6 on the belt 12, as indicated at 19. As a result, the metal foil is weakened along the circumference of the perforation, both at the top and the bottom of the web-like material, as indicated at 20 and 21.

The thus treated web of material, lying on the substantially horizontal track 13 of the belt 12, is then conducted further in the direction of roller 11. In the region between hold-down roller 14 and roller 11, the web of material is sprinkled with small articles of magnetizable material, e.g. iron discs, rings or granulates. By small articles in this connection are meant articles whose dimensions are small relative to the diameter of the perforations.

For sprinkling the web of material, there is provided a diagrammatically shown sprinkler 22, which may be constructed in various manners known for the purpose and which in the present embodiment includes a hopper 23 having a bottom orifice terminating above an endless belt 24. Via the endless belt the small articles are sprinkled on the web to be sprinkled, as indicated at 25. The sprinkler should effect a uniform sprinkling over the entire width of the web. If necessary, a plurality of hoppers and endless belts may be used side by side to this effect. It is also possible to have a relatively narrow endless belt or another supply member for distribution from a hopper or the like of the small articles over the web of material make a horizontal swivelling movement over the width of the material web or to use a hopper having a controllable orifice having the width of the web of material.

The web of material sprinkled with the magnetizable articles then reaches roller 11, being a magnetic roller attracting the small articles lying on the web. Roller 11 may be provided for this purpose with permanent magnets disposed in or on the sheath of the roller, or be provided with electric magnets.

The web of material 16 is in contact with the magnetic roller 11 only over a small portion of the surface of said roller and, after passing the magnetic roller, is conducted further to a set of deflector rollers 26, 27. The small magnetizable objects present on the web in the regions between the perforations, when passing the magnetic roller, true, are attracted by the magnetic roller but remain on the web and are conducted further with the web.

The magnetizable objects lying on the portions of the metal foil pressed into the perforations, however, are attracted at such a force that the metal foil adjacent the earlier provided weakenings 20 or 21 comes loose at the moment when the web withdraws from the surface of the magnetic roller.

This is shown in greater detail in FIG. 4. The web of material sprinkled with small magnetizable objects 40 moves from the left to the right over the magnetic roller 11. When passing the magnetic roller, the objects 40 are attracted, with the strength of the magnetic field being chosen such that the small objects present on the metal foil adjacent the perforations 6 exert such a force on the metal foil that this comes loose at the weakened places along the circumference of each perforation. The start of this process is shown in FIG. 4 for the perforation 6'.

While the web 16 is conducted further and leaves again the magnetic field of the roller 11, discs of metal foil 41, having the size of the perforations in the web, remain on the belt 12 wrapped about roller 11, since the magnetizable objects 40' lying on the discs 41 are still attracted by the magnetic roller 11. When the web has passed the magnetic roller the perforations 6 are thus entirely open, as shown at 6''.

On the underside of the magnetic roller, belt 12 moves away from the magnetic roller so that the discs of metal foil 41 and the objects 40' lying thereon get beyond the influence of the magnetic field and fall off the belt 12, as shown at 42. The metal foil discs falling off belt 12 and the small objects are collected by a funnel 28(FIG. 2) and then supplied to a separator, not shown, e.g. a shaker screen, separating the discs from the small objects. The small objects can then be supplied again to the sprinkler, while the discs of metal foil are collected and are reusable as recycled material after re-melting.

The web of material with open perforations is supplied to a deflector roller 26 where the small objects still lying between the perforations on the web fall off the web and are collected in a receptacle 28. The collected small objects are then returned somehow to the sprinkler, as shown in a broken line 29.

The web of material is subsequently supplied, e.g. via a second deflector roller 27 to a take-up device processing the web of material to rollers, each containing a given length of material.

It is observed that the foregoing only describes one embodiment of a method and an apparatus for manufacturing a roofing material according to the present invention. Other methods for opening perforations covered by a metal foil are conceivable. For instance, use could be made of a vacuum device 50 loosening and removing the discs of metal foil pressed into the perforations and weakened along the circumferential edge.

In this case, after the weakening station formed in the embodiment described by roll 10 and hold-down roller 14, only one vacuum device 50 is necessary and the sprinkler, the magnetic roller and the endless belt 12 can be dispensed with. Instead of one vacuum device 50 or in combination therewith, also a blower could be employed, which blows the discs of metal foil weakened along the circumferential edge of the perforations out of the perforations.

It is observed that on application of vacuum device, this is arranged preferably at the side of the web-like material not provided with the metal foil, while on application of a blower, this is disposed preferably at the metal foil side.

Furthermore, after the foregoing, various modifications of the apparatus described are obvious to one skilled in the art. For instance, the elastic sheath 15 of the hold-down roller 14 could be designed as a kind of brush having flexible but firm hairs or thin synthetic plastics fingers. As an alternative for the sheath 15, also an endless belt of the same material could be used which is wrapped about a plurality of rollers and which is pressed by hold-down roller 14 against the web of material supported by belt 12 and roll 10.

Besides, more hold-down stations could be employed. Also, the web of material adjacent the hold-down roller 14 could be brought in a slightly convex position, so that the metal foil is tensioned. This can be effected in a simple manner by supplying the web to roll 10 not horizontally but obliquely from the bottom, as shown in broken line 30 in FIG. 2, and by displacing hold-down roller 14 to point 31. To reinforce this effect, the diameter of roll 10 could be smaller.

These and similar modifications are deemed to fall within the scope of the present invention.

What I claim is:

1. Apparatus, for use with roofing material of the type having perforations formed through a bitumenized web material and a non-adhesion surface on one side of the web material and a metal foil covering both the other side of the web material and the perforations, for removing the metal foil covering the perforations, comprising:

a first, weakening station for weakening the metal foil along the circumferential edges of the perforations; and a second, removing station for removing the circumferentially weakened metal foil portion covering the perforations.

2. An apparatus according to claim 1, characterized in that the weakening station comprises at least one rotating back-up roll supporting the web material with a part of its circumference at the non-adhesion surface side and at least one hold-down roller pressed with an elastically deformable sheath against the metal foil side of the web material, while the metal foil portions above the perforations are pressed into the perforations and are weakened along the contour line of each perforation.

3. An apparatus according to claim 2, characterized in that the elastically deformable sheath has a brush shape.

4. An apparatus according to claim 2, characterized in that the elastically deformable sheath is formed by an endless belt wrapped about a plurality of rollers, said endless belt being pressed against the web material by the hold-down roller.

5. An apparatus according to claim 1, characterized by a substantially horizontal transport track via which the web material with the metal foil side up, is supplied from the weakening station to the removal station, while above the substantially horizontal track, there is positioned a sprinkler sprinkling the top of the web material with small magnetizable objects, with the removal station comprising a magnetic device which attracks the small objects and, insofar situated on the metal foil portions pressed into the perforations, loosens the same together with the portions pressed into the perforations, thereby removing the same from the perforations.

6. An apparatus according to claim 5, characterized in that the magnetic device is formed by a rotating magnetic roller over which the web material is conducted and which, while the surface portion of the roller situated at a given moment adjacent the web material, moves away, through rotation, from the web material, retains the loosened metal foil portions via the superimposed small objects, and on continued rotation, releases the same subsequently.

7. An apparatus according to claim 6, characterized in that about the magnetic roller is wrapped an endless belt which lies between the web material and the magnetic roller, and that the endless belt is conducted in such a manner that this moves away from the magnetic roller at an interspace from the web material, so that the influence of the magnetic roller on the retained small objects is reduced and the loosened metal foil portions and the associated small objects fall off the endless belt.

8. An apparatus according to claim 7, characterized in that the endless belt is also wrapped about the back-up roll and forms the substantially horizontally transport track.

9. An apparatus according to claim 5, characterized in that the web material, after leaving the magnetic device via a substantially horizontal track, reaches a deflector roller deflecting the web material downwardly, so that the small objects lying on the material web fall off the web material into a collecting device.

10. An apparatus according to claim 5, characterized in that the small objects are iron plates or rings which are small relative to the dimensions of the perforations.

11. An apparatus according to claim 1, characterized by a vacuum device following the weakening station, said vacuum device loosening and discharging the metal foil portions pressed into the perforations.

12. An apparatus according to claim 1, characterized by a blower loosening the metal foil portions pressed into the perforations.

* * * * *